United States Patent [19]

Jacoby

[11] 4,221,433

[45] Sep. 9, 1980

[54] RETROGRESSIVELY IN-SITU ORE BODY CHEMICAL MINING SYSTEM AND METHOD

[75] Inventor: Charles H. Jacoby, Tempe, Ariz.

[73] Assignee: Occidental Minerals Corporation, Lakewood, Colo.

[21] Appl. No.: 926,465

[22] Filed: Jul. 20, 1978

[51] Int. Cl.[2] ..... E21B 43/28

[52] U.S. Cl. ..... 299/4; 166/271

[58] Field of Search ..... 299/2, 4, 5, 19; 166/50, 259, 271; 175/61, 62

[56] References Cited

U.S. PATENT DOCUMENTS

| | | | |
|---|---|---|---|
| 2,788,956 | 4/1957 | Pevere et al. | 166/259 |
| 2,818,240 | 12/1957 | Livingston | 299/4 |
| 3,223,158 | 12/1965 | Baker | 166/259 |
| 3,415,321 | 12/1968 | Venghiattis | 166/297 |
| 3,441,316 | 4/1969 | Hannifan et al. | 299/5 |
| 3,822,916 | 11/1972 | Jacoby | 299/4 |
| 3,873,156 | 3/1975 | Jacoby | 166/271 X |
| 3,915,499 | 10/1975 | Mallon et al. | 299/4 |

FOREIGN PATENT DOCUMENTS

| | | | |
|---|---|---|---|
| 747984 | 4/1956 | United Kingdom | 299/4 |

*Primary Examiner*—Ernest R. Purser

*Attorney, Agent, or Firm*—Arnold Grant

[57] ABSTRACT

An improved in-situ ore body chemical-mining system and method are disclosed, whereby it is practicable to mine an ore body of substantially horizontally extended configuration which would otherwise be uneconomical because of adverse overhead or overburden conditions. Beginning adjacent the distal ends of two or more generally horizontally drilled and substantially parallel bore holes which are drilled into the ore body from an elevation substantially similar to that of the ore body, a combination of permeabilizing and mining processes are applied to the body of ore circumjacent the horizontal penetration. The permeabilizing and mining processes are retrogressively applied to successive blocks of the ore body retreating by stages from the distal region of the penetration towards the entry region thereof.

29 Claims, 6 Drawing Figures

4
10
17
NEXT
BLOCK TO BE
PERMEABILIZED
PERMEABILIZED
BLOCK
19
20a
20
18
22a
22
4

17
18
19
10
20
20a
22
22a

RETROGRESSIVELY IN-SITU ORE BODY CHEMICAL MINING SYSTEM AND METHOD

BACKGROUND OF THE INVENTION

The present invention relates to the winning of mineral values from underground ore bodies. More particularly, the present invention relates to an improved method and system for effecting in-situ mining of ore bodies containing mineral values which lie in generally horizontally extended attitudes and are overlain by surface features or an overburden which would handicap usage of conventional mining techniques.

Various methods are known for winning minerals from underground ore bodies; typical are vertical shaft access mining which involves mechanically extracting broken ore from the deposit by driving entries and/or stopes into and throughout the ore body, and chemical recovery by a variety of underground in-situ solution mining or chemical-reaction processes; examples of these methods are disclosed in U.S. Pat. Nos. 2,251,916, 2,682,396, 2,976,690, 3,022,986, 3,695,711, 3,822,916, and 3,873,156.

While such processes have utility in most circumstances, they are not efficient in situations where a generally horizontally extending ore body is covered by an overburden which is of such nature as to handicap conventional vertical shaft or surface operated solution mining approaches to the ore body. The ore body may, for example, be overlain by a body of water, or by an overlying geological formation which is difficult, and therefore expensive, to penetrate.

Still another situation in which conventional method access to an ore body is uneconomical or otherwise impracticable occurs wherever the sought-for mineral is located under a densely populated or industrialized area. In these cases employment of typical vertical shaft access mining systems could require purchases of expensive above-ground real estate or could conflict with zoning restrictions and environmental requirements.

The above mentioned disadvantages of the prior art are particularly troublesome and may preclude economical exploitation of relatively thin layered mineral deposits such as are located at substantial depths below the earth's surface. There thus exists the need to provide a mining technique whereby a horizontally extended ore body with the aforementioned impediments may be more efficiently and inexpensively mined.

SUMMARY OF THE INVENTION

The present invention provides a mining system and method which overcomes the disadvantages of prior mining techniques in relation to the problem of mining a generally horizontally extended ore body lying under an overburden which is of such character as to preclude economical usage of prior known mining techniques. To this end at least one group of generally horizontally extended bore holes, each group comprising at least one production hole and at least one injection hole are driven into and distantly away from an exposed face located at substantially the same vertical elevation as the ore body. The particular number of injection holes and production holes most suitable for a given situation is generally a function of several factors such as the nature of the ore and its host rock, economics, the thickness of the ore body, and the lixiviant being used. In a preferred embodiment there is at least one production hole for each injection hole; in the most preferred embodiment, the production and injection holes are paired, i.e., one production hole for each injection hole. The exposed face may be at the bottom of a vertical shaft, or at some equal elevation "outcrop" of the ore body. The bore holes are guided and driven so as to maximize their penetrations inside the ore body while the injection and production holes terminate at their distal ends in such proximity to each other as to accommodate therebetween an intercommunicating ore body fracturing technique, to be described in greater detail hereinafter.

The above referred to group of bore holes preferably extends generally horizontally but with the production and injection holes in vertically displaced relationship from one another; thus being substantially parallel to one another. In a preferred embodiment, the injection holes are uppermost relative to the production holes and are formed with a slightly vertically declining attitude away from their point of entry into the ore body, and the production bore holes are directed so as to incline with a slightly vertically rising attitude towards their distal end.

The ore body containing the sought for mineral between the distal ends of the bore holes is initially cracked, for example, by means of the hydraulic fracturing process shown in my earlier U.S. Pat. No. 3,822,916, the disclosure of which is incorporated herein by reference. The cracking may, if required, be enhanced by loading the ore body with a liquid or slurry type explosive and then detonating the explosive. Ideally, the cracking process is facilitated if the distal end of the bore holes through which the explosive is introduced to the ore body are located adjacent to an ore body weakness zone such as a slip, fault or brecciated zone traversing the body. Alternatively, if the ore body is of an incipiently porous nature with the granules thereof being partially cemented together by, for example, a calcareous substance, a cement solubilizing agent may be circulated through the deposit to effect the desired cracking.

Cracking rendors the ore body circumjacent to the distal end of the bore hole permeable to circulation of a lixiviant which carries away the sought-for mineral content of the ore body. As used herein the term lixiviant includes any liquid or gas or combination thereof which reacts with, dissolves or otherwise carries away from the host rock the sought-for mineral in the ore body. Because the injection bore holes vertically decline towards their distal end and the production bore holes slant back downwardly towards their entry elevation, a suitable lixiviant will readily flow from the one or more entry stations into and throughout the permeabilized zone of the ore body and out of the production bore holes, assisted by gravity. The desired mineral values are thereby carried away from the host rock; the product thereof being withdrawn through the production bore holes for delivery to the surface processing plant.

In another aspect, the present invention features usage of the aforesaid techniques concomitant with retrogressive permeabilizations of different zones of the ore body in stages, starting with the most distant from the entries of the horizontal drilling operations into the ore body, and subsequently retreating therefrom toward the entries. In accordance with this method virtually all of the ore body may be mined to exhaustion without requiring the sinking of more than one vertical shaft; or alternatively, establishing more than one drilling operation into the ore body from a similar level outcrop of the ore body. Incidental to the retrogressive mining operations, it is desirable to backfill the previously depleted zones of the ore body with a filler medium such as an inert waste material, cement, or the like, so as to block off and prevent uneconomical continuance of input lixiviant into the previously mined-out zones.

A further embodiment of the invention includes at least one bore hole for removal of any gases evolved as a result of the interaction between the lixiviant and the desired mineral value. This aspect of the invention also includes a method for regulating the withdrawl of the gases to thereby concomitantly control the vertical progress of the mineral withdrawal process.

The present invention has application to the mining of any mineral bearing ore bodies susceptible of being separated from its host rock by a lixiviant. Examples of minerals which are particularly suited for, but which are not limitations on the scope of the invention, include copper, uranium, nickel, cobalt, molybdenum and aluminum.

THE ACCOMPANYING DRAWINGS

DETAILED DESCRIPTION

Figure 1:
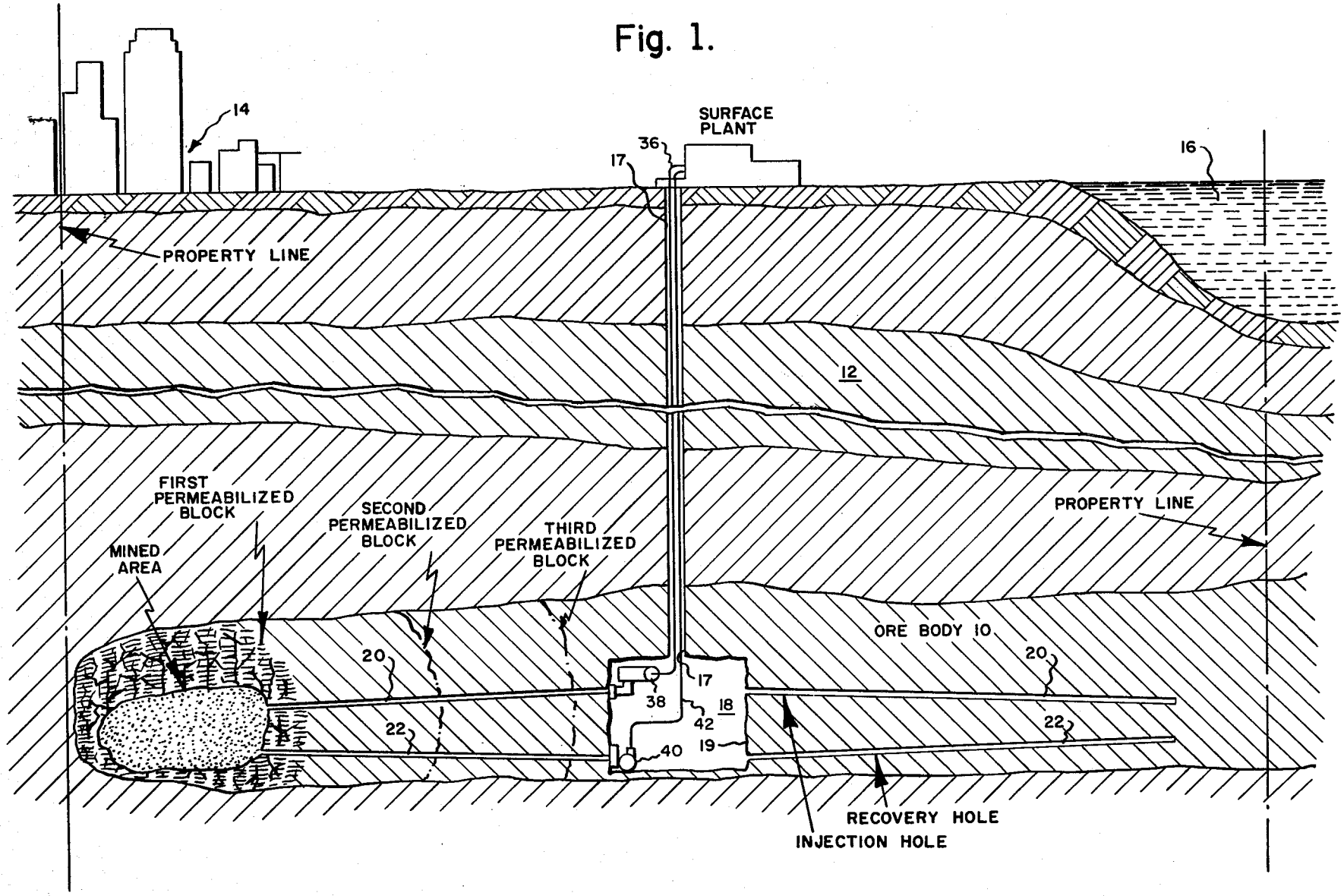
FIG. 1 is a vertical geological section showing a typical ore body of the horizontally extended type, overlain by formations which are economically disadvantageous to penetrate.

FIG. 1 illustrates a mining operation conducted in accordance with the present invention. The geologic section shown contains an ore body 10 lying, under a difficult-to-penetrate hard-rock shelf 12 as well as under a municipality 14, and a body of water 16. In order to mine the ore body 10 a vertical shaft 17 has been sunk to a level approximately coincident to that of the lower elevation of the ore body 10. As shown, the entrance shaft 17 is sunk from a surface position which avoids intersection with the difficult-to-penetrate stratum 12 or interference with surface obstacles or political ordinances. Only a single shaft is shown, although others for escape and/or ventilation may also be provided.

Figure 2:
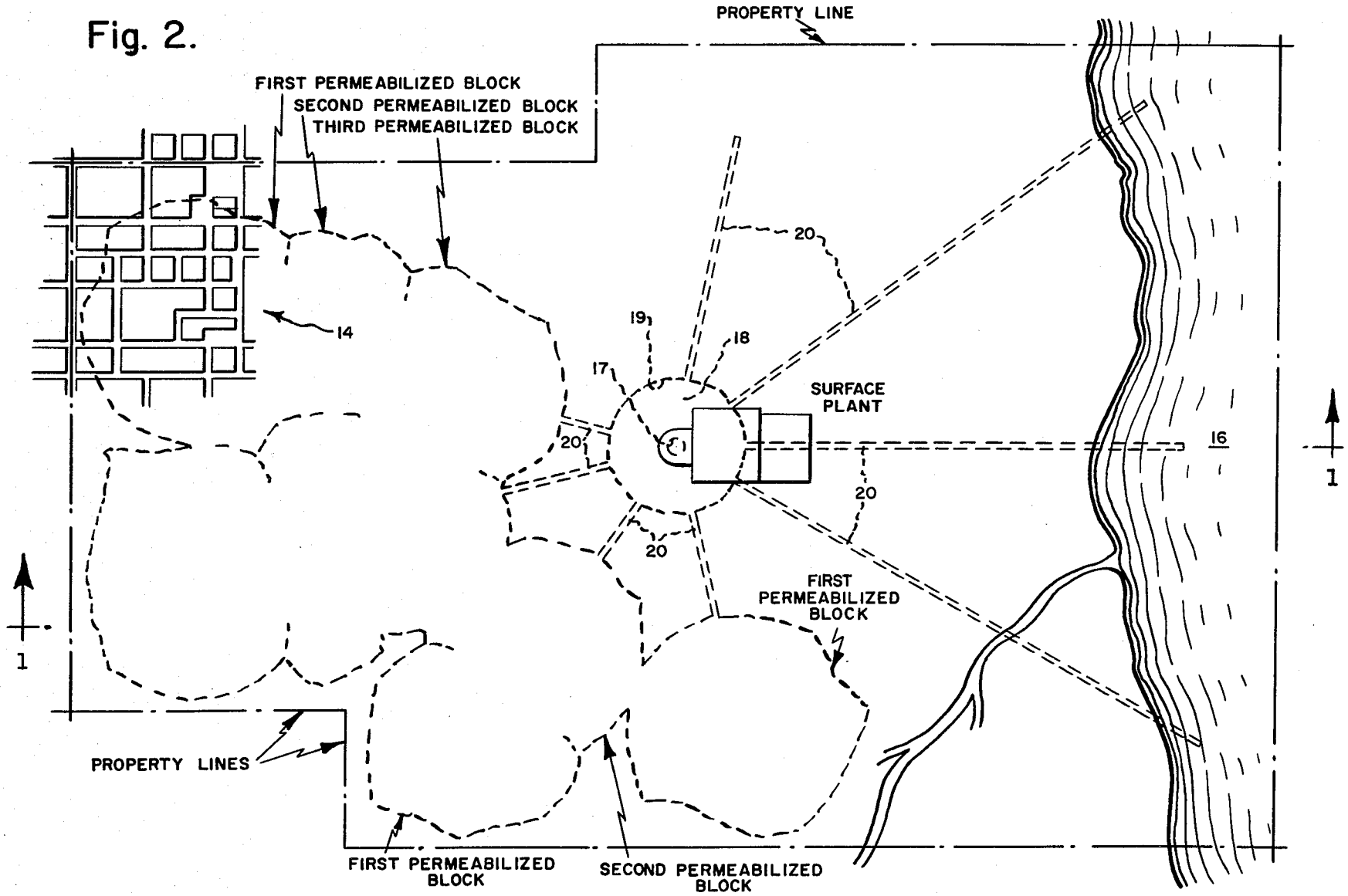
FIG. 2 is a plan view further illustrating the operation of the invention.
Figure 3:
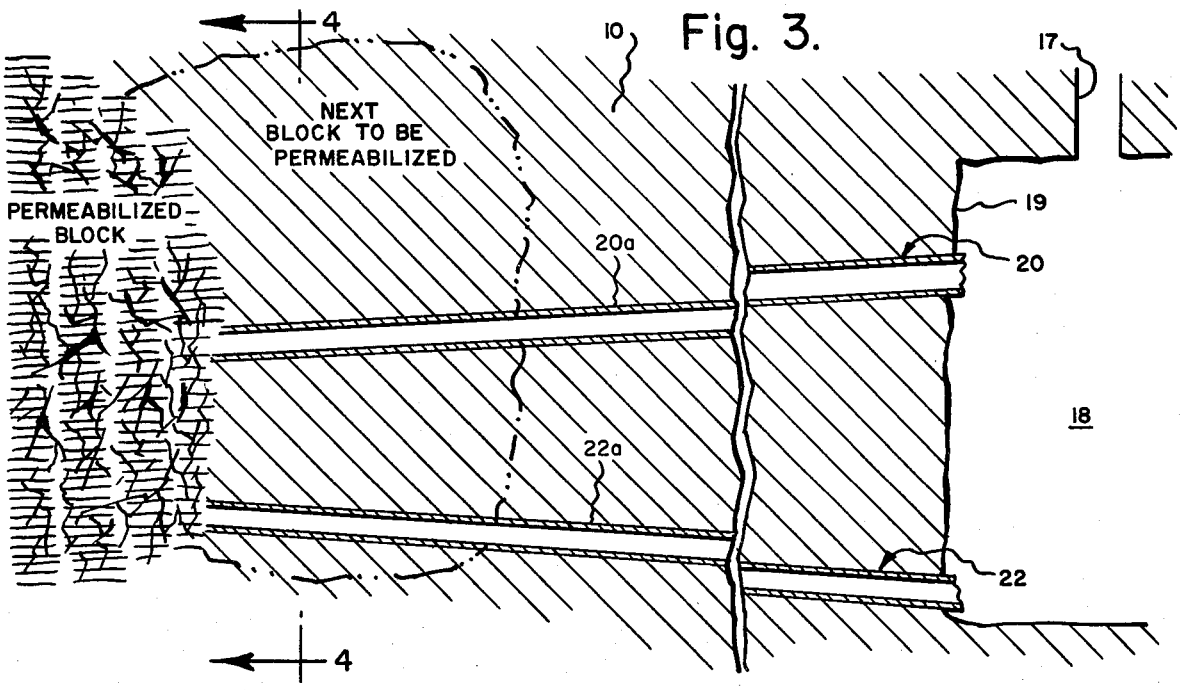
FIG. 3 is a fragmentary enlarged scale sectional view corresponding to a portion of FIG. 1, illustrating the mining operation at an intermediate stage.
Figure 4:
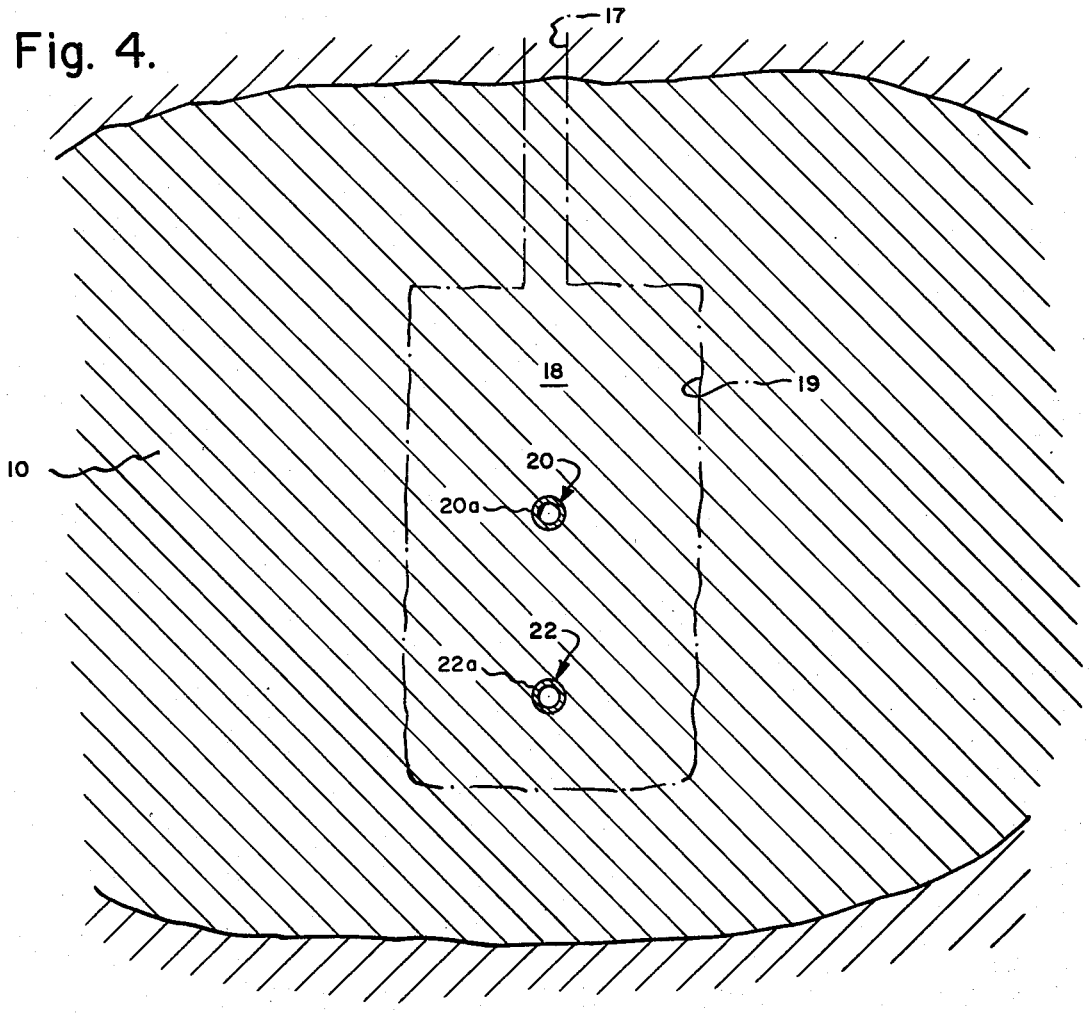
FIG. 4 is a fragmentary sectional view taken along the line 4—4.

A larger diameter chamber 18 at the bottom of the shaft 17 is then opened to provide a circumscribing face 19 into and through which one or more groups of bore holes can be driven in generally horizontal attitudes. Each group of bore holes comprises at least two holes, at least one of which is a production hole and at least one of which is an injection hole. The number of injection holes and production holes and the spacing and relationship between them for a particular group is a function of such factors as the nature of the ore and host rock, economics, the thickness of the ore body and the lixiviant being used. In the embodiment shown in FIG. 4, the group can comprise a plurality of production holes 22 positioned about an injection hole 20. Alternatively, as shown in FIG. 4A, the group can comprise a plurality of production holes 22 positioned about a plurality of injection holes 20. In a preferred embodiment the production and injection holes are paired, i.e., one production hole for each injection hole. The injection holes may be in the same horizontal plane as the production holes although in a preferred embodiment the production holes are positioned beneath the injection holes. Moreover, as best seen in FIG. 2, the single underground working chamber 18 may be employed to accommodate lateral projections therefrom into and throughout the ore body by means of pluralities of groups of bore holes.

The bore holes 20 and 22 are, as stated, preferably vertically displaced relative to one another and extend in substantially horizontal attitudes to the extent prescribed by the limitations of the ore body or the property rights of the mining concern. Also preferably the upper or injection bore holes 20 have a slightly declining attitude from their point of entry to their distal end, and the lower or production bore holes 22 have a slightly vertically rising attitude therefrom. This allows the lixiviant to flow through the injection bore holes 20 and the desired mineral values to flow through the production bore holes 22 with the assistance of gravity. Alternatively, a suitable pumping system 38 for the injection bore holes and a suitable pumping system 40 for the production bore holes may be utilized.

The horizontal bore holes may be drilled by any of the known techniques, such as shown in U.S. Pat. Nos. 3,878,903, 4,003,440, and 4,051,911 the disclosures of which are incorporated herein by reference. According to the method of that patent the bore hole is drilled by encasing the core bit of a rotary drill within a core barrel. The interior drill rod thereof being modified by provision of a collar or stabilizer shell which is slightly smaller in diameter than the outside diameter of the diamond bit, while still being larger than the core barrel, and longitudinally adjustable thereon. This shell is located on the barrel at a predetermined distance behind the core bit, so that the rear end of the barrel which is constructed of a heavy wall tubing acts as a lever on the fulcrum of the shell. With this arrangement the angle of inclination of the hole being drilled can be controlled with a high degree of accuracy by adjusting the location of the fulcrum-shell.

If the bore holes intersect a geological zone of weakness 25, such as a fault, slip or breccia zone they may be sealed off along the extent of the fault through the use of tubular casings or surrounding concrete pillars 26. This will prevent short circuiting of the lixiviant and enable retrogressive mining of the ore body along its full length.

Upon completion of each of the groups of ore body penetrating bore holes, a first zone of ore body adjacent to and intermediate the remote ends of the bore holes is cracked or otherwise rendered permeable such as by the fracturing and cracking process disclosed in U.S. Pat. No. 3,822,916. This permeabilizing process consists of first fracturing the ore body consistent with the schistosity thereof, by the introduction of an hydraulic fluid such as water or other pressure inducing means into the ore body, and then propping open the created fissures or cracks by introducing a propping agent such as sand or other granular material. The permeabilizing process may be facilitated by directing it into any available naturally occurring zones of unusual weakness. A slurry type explosive material is then pumped into the openly propped fissures and detonated to further permeabilize the ore body. Other techniques for permeabilizing an ore body and for performing these steps are known and disclosed in the prior patents cited hereinabove and incorporated herein by reference.

The lixiviant may then be caused to flow either by pumping or by assistance of gravitational forces through bore hole 20 and then to percolate throughout the permeabilized portion of the ore body. As the input lixiviant reacts with, dissolves or otherwise carries away the sought-for minerals, which are heavier than the fresh input solution, they are withdrawn through the lower bore hole 22 for delivery through conduit 42 to the surface plant for processing. The process is continued until the first ore body zone has been mined to the desired extent. The particular lixiviant used depends upon the mineral being mined. However, by way of example and not as a limitation on the invention, typical fluids are acids such as sulfuric acid, hydrochloric acid and nitric acid. Also by way of example, the preferred lixiviant for copper is sulfuric acid.

In a preferred embodiment, the entire ore body 10 may be mined by repeating the initial permeabilizing and mining steps, retrogressively, throughout successively retreating ore body zones within the ranges of the bore holes 20, 22. A variety of techniques may be employed to backfill or otherwise block off the previously mined and depleted zones in the ore body in each succeeding zone thereof. For example, upon completion of the drilling of the bore holes 20, 22, or incidental to the drilling thereof, into the region of the first zone of the ore body as shown herein, the bore holes may be cased as indicated at 20*a* and 22*a* to the remote ends thereof. The hydraulic fracturing and propping operations may then be applied through one of the cased bore holes, thus localizing the fracturing process initially to the first zone of the ore body. The fluid explosive is then pumped through the casing and into the fractured zone of the ore body, and is subsequently detonated to permeabilize that zone of the ore body.

Alternatively, either at the same time, or subsequent to, drilling of the bore holes 20, 22, one of the holes may be cased from its entry end to a distance short of its distal end which coincides with the lateral extent of the desired first zone of the ore body. This technique leaves the desired zone of ore exposed to the fracturing, propping, and permeabilizing operations to be subsequently applied; and in preparation for the latter zones suitable packers, plugs or combinations thereof may be employed to concentrate the fracturing and permeabilizing effects wherever desired as is known in the art and disclosed for example in U.S. Pat. Nos. 3,022,986 and 4,015,663, the disclosures of which are incorporated herein by this reference. The same methods may be employed when preparing to mine each succeeding zone of ore. Intermediately thereof the casings may either be withdrawn in sections equivalent to the desired extents of each succeeding zone of ore, or may be cemented in place within the bore holes so as to preclude unwanted back-tracking of the pumped-in lixiviant externally of the casing towards the entrances of the bore holes. In such case the casings will be packed and/or plugged and perforated intermediately thereof such as by shaped charges as explained in the referenced patents, so as to direct the permeabilizing operations against each successive ore zone as efficiently as possible.

Thus, a variety of methods involving alternative usages of casings, packer/plug devices, and casing perforating methods may be employed, all in accordance with local geologic and mineralization conditions and engineering and economic preferences. Incidental to retreat of the mining operation from one zone of ore to the next, the injection bore hole 20 through which the lixiviant is to be introduced to the ore is preferably plugged so as to isolate the previously mined zone of the ore body from the succeeding permeabilizing process while concentrating it on that zone of ore.

Inasmuch as the bore holes 20, 22 throughout their lengths preferably lie within the ore body 10, the lixiviant flowing therethrough if not cased may tend to infiltrate the walls of the holes. If this is permitted to unduly continue open slots may be formed therebetween, which would cause premature short-circuiting of the fluid input from injection hole 20 to production hole 22 and thus possible loss of valuable extractable ore reseves occurring between the remote end of the hole and the point of short-circuit. In order to avoid this undesirable result, the bore holes 20 may be lined with a suitable chemically non-reactive tubing, preferred are plastics and fiberglass.

Figure 5:
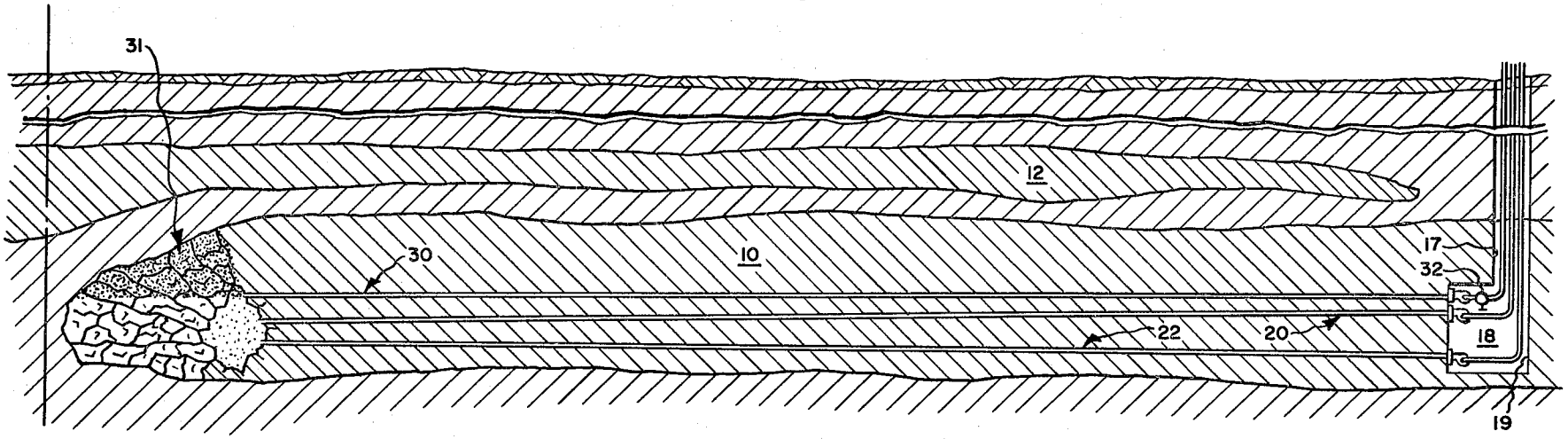
FIG. 5 is a sectional view corresponding to a portion of FIG. 1, showing a preferred form of the mining technique.
Figure 6:
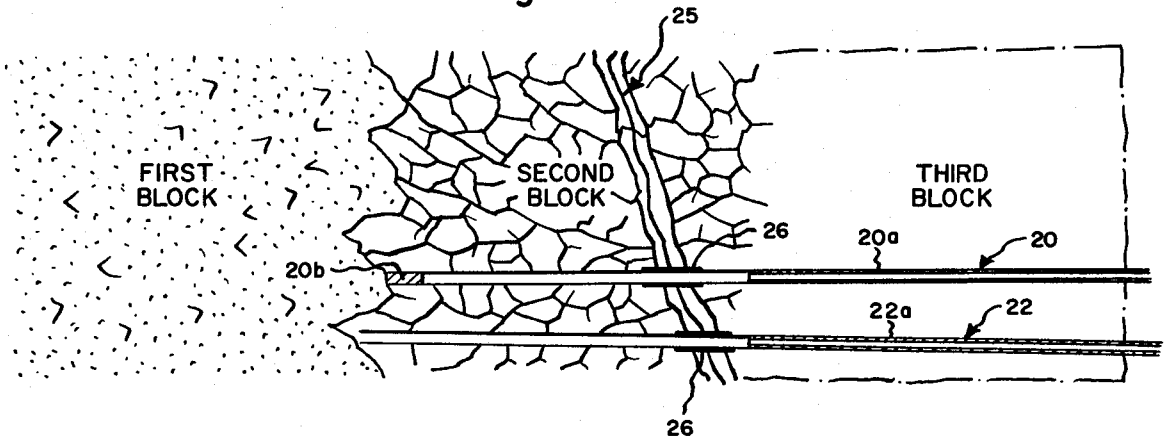
FIG. 6 is a sectional view illustrating how successive blocks of the ore body are retrogressively mined.

The interaction between the lixiviant and the mineral values within the ore body will often produce by-product gases, such as, for example, carbon dioxide, the particular gas or gases depending upon the nature of the ore, the lixiviant and if the interaction is a chemical reaction. Such gases sometimes tend to build up and pressurize the permeabilized zones of the ore body and may interfere with the desired mining process. Therefore, provision is preferably made for monitoring and for ready escape and removal of evolved gases from the operation. For example, the upper bore hole 20 may include a string of concentric casings (not shown) so that the lixiviant may be injected into the ore body 10 through its central tube while the gaseous by-products are allowed to exit through the concentric annulus between the tubes. Another arrangement, shown in FIG. 5, is to drill at least one gas removal bore hole 30 preferably above the group of holes 20, 22 to inter-connect the ore body zone being mined with the chamber 18. Thus, the evolved gases may exit therethrough for either economically useful recovery or waste disposal at the surface.

The developed gas pressures are preferably employed underground to regulate vertical progress of the level of the sought for mineral value-lixiviant interface in the permeabilized portion of the ore body, by provision of an elevation-controllable gas "pad" 31. The level of the bottom of the gas pad 31 is readily controlled by means of a valve 32, to prevent precipitous progress of the reaction process vertically. Thus, maximum winning of the lowermost located mineral "values" may be realized, as well as preventing "hit-or-miss" channelings of the lixiviant into and/or toward the roof of the permeabilized zone. As long as profitable values are being mined from the lower levels of the ore body, the rate of vertical progression of the operation within the permeabilized block of ore may be thus regulated under control of the mine operator as suggested by output assay results.

In either case the lixiviant may be introduced as explained hereinabove such as through conduit 36 either with or without the assistance of a suitable pumping system 38. The product output solution will typically be pumped up to the surface plant such as by pump 40 and conduit 42; or if preferred it may be reduced to solid form in the mine and then elevated to the surface plant.

It is also a particular feature of the present invention that the mined blocks of ore may be retrogressively prepared for abandonment in a manner which reduces the possibility of environmental pollution problems typically incurred in connection with conventional "solution mining" systems. In the case of the invention each block of mined ore may be readily evacuated of residual input lixiviant and/or product materials, by water-flooding or air-flushing such materials out of the mined block of ore by means of the intercommunicating bore hole system. Subsequent to evacuation the abandoned blocks of ore can be plugged off from the succeeding block mining operations such as by means of expanding cement plugs or the like located at appropriate positions in association with the bore holes.

Although this invention has been described in detail with reference to certain versions thereof, other versions and modifications thereof can be practiced. Therefore, the spirit and scope of the appended claims should not be limited to the description of the preferred versions contained herein.

What is claimed is:

1. A method for winning desired mineral values from an ore body comprising the steps of:

a. penetrating the ore body with a group of at least two spaced apart bore holes extending to prescribed extents from their points of entry to their distal ends in generally horizontal attitudes and in substantially parallel relation;

b. rendering a first block of the ore body located in the region of the distal ends of the bore holes permeable to fluid travel therethrough;

c. mining the first block of the ore body by injecting a lixiviant through one of the bore holes and into the permeabilized first block of ore while withdrawing product fluids containing the desired mineral values through another of said bore holes to form a mineral depleted first ore block; and d. successively rendering permeable and then mining by injection of a lixiviant retrogressively located zones of ore within said ore body from the distal ends of said bore holes to the entry points of said bore holes circumjacent to and by way of said bore holes.

2. The method as recited in claim 1 wherein the step of rendering the ore body permeable comprises:

a. fracturing the ore body by means of introducing an hydraulic fluid into the ore body through one of the bore holes;

b. propping open the fractures so formed within the ore body by introducing a propping agent into the fractures;

c. introducing an explosive into the propped fractures; and d. detonating the explosive to fragment the ore body in a region adjacent to the bore holes.

3. The method as recited in claim 1 wherein the step of penetrating the ore body with spaced apart bore holes includes driving at least one of said bore holes in a substantially horizontal direction but with a vertically rising attitude from its point of entry into the ore body to its distal end.

4. The method as recited in claim 3 wherein product fluids are withdrawn through at least one bore hole.

5. The method as recited in claim 1 further including the step of penetrating said ore body by means of at least one gas removal bore hole in generally parallel association with said spaced apart group of bore holes.

6. The method as recited in claim 1, further including the step of initially forming within said ore body an open chamber at substantially the mean elevation of the ore body, and wherein the steps of penetrating the ore body by way of the spaced apart group of bore holes includes the step of drilling the bore holes substantially horizontally through a vertical face of the chamber.

7. The method as recited in claim 1 wherein said steps of penetrating said ore body by way of spaced apart group of bore holes includes the step of drilling said bore holes into an exposed outcrop face of a geological formation which is at substantially the mean elevation of the ore body.

8. The method as recited in claim 1, further including the step of lining the bore holes through which the lixiviant is introduced with a lining which is non-reactive with said lixiviant.

9. The method as recited in claim 8, further including the step of perforating said lining at at least one selected position therealong.

10. The method as recited in claim 9 further including the step of perforating said lining at at least one selected position therealong prior to successively rendering permeable and then mining a retrogressively located zone within said ore body.

11. The method as recited in claim 10 wherein said step of perforating said lining includes the steps of placing a shaped charge at the desired location within said lining and detonating the shaped charge so as to perforate the lining in a preferred direction.

12. The method as recited in claim 1 further including the step of blocking off the zones of the ore body which have been previously mined.

13. The method as recited in claim 12, further including the step of lining the bore holes through which said sought-for mineral reactive fluid is introduced with a lining which is non-reactive with said sought-for mineral reactive fluid.

14. The method as recited in claim 1 wherein the step of penetrating the ore body with spaced apart bore holes includes driving at least one of said bore holes in a substantially horizontal direction but with a vertically declining attitude from its point of entry into the ore body towards its distal end.

15. The method as recited in claim 13 wherein the lixiviant is introduced through at least one bore hole.

16. The method as recited in claim 14 wherein the step of rendering the ore body permeable comprises the steps of:

a. fracturing said ore body by means of introducing an hydraulic fluid to the ore body through said at least one bore hole;

b. propping open said fractured ore body by introducing a propping agent into the fractures thereof;

c. introducing an explosive into the propped fractures; and d. detonating said explosive to fragment said ore body in a region environmental to said at least one bore hole.

17. The method as recited in claim 1, further including the step of injecting a non-reactive medium into said mineral depleted zone.

18. The method as recited in claim 17 further including the step of successively blocking off those zones of the ore body which have previously been mined from said at least one bore hole prior to retrogressively mining each succeeding zone of the ore body from said at least one bore hole.

19. The method as recited in claim 1 further including the step of penetrating the ore body with at least one gas removal bore hole to remove from the ore body gases evolved during the mineral winning process.

20. The method as recited in claim 19 further comprising the step of controlling the rate of exit of the gases evolved during the mineral winning process through the gas removal bore hole.

21. The method as recited in claim 19 further comprising the step of controlling the vertical level of the interface between the sought for mineral value and the lixiviant.

22. The method as defined in claim 1 wherein there is at least one bore hole for injection of the lixiviant to the ore body and at least one production bore hole for removal of products from the ore body including the sought-for mineral values.

23. The method as defined in claim 22 wherein at least one injection well and at least one production well are in substantially the same horizontal plane.

24. The method as defined in claim 22 wherein there is a production hole for each injection hole.

25. The method as recited in claim 1 wherein the step of penetrating the ore body with spaced apart bore holes includes driving at least one of said bore holes in a substantially horizontal direction but with a vertically inclining attitude from its point of entry into the ore body toward its distal end.

26. A system and apparatus for mining a sought-for mineral from an ore body lying in a substantially horizontally extended attitude within a geological formation having an overlying formation comprising:

a. a first fluid conductor bore hole extending substantially horizontally into said ore body from a point under said overlying formation;

b. a second fluid conductor bore hole disposed substantially parallel to said first fluid conductor and extending into said ore body adjacent said first fluid conductor;

c. a body of permeabilized ore environmental to the distal ends of said first and second conductors;

d. means whereby a lixiviant may be introduced through one of said bore holes to travel within said permeabilized ore body to said second bore hole, from which mineral products are removed; and, e. a third horizontally extending fluid conducting bore hole within the ore body for removing therefrom chemically evolved gases.

27. A method for winning sought-for mineral values from a substantially laterally extending ore body which comprises the steps of:

a. penetrating said ore body by at least two bore holes which extend generally horizontally and into said ore body from the region of penetration to a distal region at which winning of sought-for mineral values is to be commenced, said bore holes being lined by means sufficient to prevent direct fluid flow communication therebetween;

b. permeabilizing, through said bore holes, a first zone of the ore body in the environment of the distal ends of said bore holes to render the ore body in said first zone ore permeable to fluid circulation;

c. mining said first zone of the ore body by injecting a lixiviant through one of said bore holes and into said permeabilized first zone of ore while withdrawing product fluids containing the sought for mineral values through the other of said bore holes until said first zone of ore is depleted to a desired extent of said sought for mineral values;

d. isolating said first zone of the ore body from said bore holes; and e. successively repeating steps b, c and d with respect to successively retrogressively located zones of said ore body circumjacent to said bore holes.

28. The method as recited in claim 27 further including the step of penetrating the ore body with at least one gas removal bore hole to remove gases evolved during the mineral winning process from the ore body.

29. The method as recited in claim 27 wherein there is at least one bore hole for injection of the lixiviant to the ore body and at least one bore hole for removal of products from the bore hole including the sought-for mineral values.

* * * * *